US010427863B2

(12) United States Patent
Sahlström et al.

(10) Patent No.: US 10,427,863 B2
(45) Date of Patent: Oct. 1, 2019

(54) AEROSOL CONTAINER, AND DETAILS THEREOF

(71) Applicant: Purple Holding AB, Malmö (SE)

(72) Inventors: Mikael Sahlström, Malmö (SE); Kenneth Hagman, Ödeborg (SE)

(73) Assignee: PURPLE HOLDING AB, Malmö (SE)

( * ) Notice: Subject to any disclaimer, the term of this patent is extended or adjusted under 35 U.S.C. 154(b) by 0 days.

(21) Appl. No.: 15/121,355

(22) PCT Filed: Feb. 27, 2015

(86) PCT No.: PCT/SE2015/050233

§ 371 (c)(1),
(2) Date: Aug. 24, 2016

(87) PCT Pub. No.: WO2015/130220

PCT Pub. Date: Sep. 3, 2015

(65) Prior Publication Data

US 2016/0362244 A1 Dec. 15, 2016

(30) Foreign Application Priority Data

Feb. 28, 2014 (SE) ..... 1450231-4
Sep. 21, 2014 (SE) ..... 1451109-1

(51) Int. Cl.
*B65D 83/32* (2006.01)
*B65D 83/48* (2006.01)
*B65D 83/38* (2006.01)

(52) U.S. Cl.
CPC ..... *B65D 83/48* (2013.01); *B65D 83/32* (2013.01); *B65D 83/38* (2013.01)

(58) Field of Classification Search
CPC ..... B65D 83/38; B65D 83/32; B65D 83/48
See application file for complete search history.

(56) References Cited

U.S. PATENT DOCUMENTS 2,854,176 A * 9/1958 Edwards ..... B65D 83/205 222/402.25
2,957,611 A 10/1960 Sagarin
(Continued)

FOREIGN PATENT DOCUMENTS

EP 2481688 A1 8/2012
JP 2006312478 A 11/2006
WO 2013019784 A1 2/2013

OTHER PUBLICATIONS

International Search Report from corresponding International Patent Application No. PCT/SE2015/050233, dated May 13, 2015.

*Primary Examiner* — Frederick C Nicolas
(74) *Attorney, Agent, or Firm* — Tucker Ellis LLP

(57) ABSTRACT

A stabilizing member (120) forming an upper valve housing for an aerosol valve (100) having a valve stem (150) for operating the valve (100), the stabilizing member (120) comprises a body (160) having a resilient portion (140) arranged at the periphery of the stabilizing member (120) for snap fitting in a groove (18) of an associated hollow body (12), and a radial projection (145) arranged at the periphery of the stabilizing member (120) and axially displaced relative the resilient portion (140), wherein the radial projection (145) is configured to seal against the associated hollow body (12). The invention further discloses an aerosol valve with such a stabilizing member, as well as a container with such a stabilizing member and a method for providing the container.

19 Claims, 4 Drawing Sheets

(56) References Cited

U.S. PATENT DOCUMENTS

| | | | | | |
|---|---|---|---|---|---|
| 3,138,304 | A * | 6/1964 | Raehs | B65D 83/14 | 222/402.13 |
| 3,372,844 | A * | 3/1968 | Kitabayashi | B65D 83/38 | 222/402.1 |
| 3,647,121 | A * | 3/1972 | Ayres | B65D 83/48 | 222/402.24 |
| 3,682,355 | A * | 8/1972 | Lo | B65D 83/20 | 222/402.1 |
| 3,819,090 | A * | 6/1974 | Birrell | B65D 83/40 | 215/223 |
| 3,977,576 | A * | 8/1976 | Amabili | B65D 83/48 | 222/402.1 |
| 4,449,647 | A * | 5/1984 | Reed | B65D 83/202 | 220/759 |
| 4,824,075 | A * | 4/1989 | Holzboog | B65D 83/46 | 222/402.22 |
| 5,083,684 | A * | 1/1992 | Ebina | B29C 45/26 | 222/394 |
| 5,277,340 | A * | 1/1994 | Van Brocklin | B05B 11/0013 | 222/321.7 |
| 6,113,070 | A | 9/2000 | Holzboog | | |
| 6,296,156 | B1 * | 10/2001 | Lasserre | B65D 45/325 | 222/394 |
| 7,261,225 | B2 * | 8/2007 | Rueschhoff | B65D 83/38 | 222/402.1 |
| 7,775,409 | B2 * | 8/2010 | Scheindel | B65D 83/48 | 222/402.1 |
| 8,418,996 | B2 * | 4/2013 | Rideg | B05B 11/3077 | 222/402.1 |
| 2008/0041888 | A1 * | 2/2008 | Scheindel | B65D 83/48 | 222/402.1 |

* cited by examiner

AEROSOL CONTAINER, AND DETAILS THEREOF

TECHNICAL FIELD

The present invention relates to an aerosol container and details thereof. More particularly, the present invention relates to a stabilizing member forming an upper valve housing for an aerosol valve, an aerosol valve as well as an aerosol container, and a method for providing such aerosol container.

BACKGROUND

Prior art aerosol containers comprise a valve cup sealing the open end of the aerosol can. An aerosol valve is arranged inside the valve cup, and a valve stem of the valve extends up through the valve cup. The entire periphery of the valve cup needs to be sealed against the can in order to provide a safe and secure aerosol container. The valve cup is crimped to the edge of the open end of the container, a process that is highly complex and time-consuming. There is thus a need for an aerosol container having a simple and cost effective construction.

SUMMARY

Accordingly, the present invention preferably seeks to mitigate or eliminate one or more of the above-identified deficiencies in the art singly or in any combination and solves at least the above mentioned problems by providing a stabilizing member, an aerosol valve, an aerosol container, and a method according to the appended patent claims.

An idea of the invention is to provide an aerosol container, and allow for the production of an aerosol container, that may be manufactured in a simple and cost-effective way.

Another idea of the invention is to provide an aerosol container that excludes the need of a valve cup. This is beneficial in many ways; shorter product chains, added design values as the container can be altered in different shapes and forms, as well as lower emission.

According to a first aspect, a stabilizing member forming an upper valve housing for an aerosol valve having a valve stem for operating said valve is provided. The stabilizing member comprises a body having a resilient portion arranged at the periphery of said stabilizing member for snap fitting in a groove of an associated hollow body, and a radial projection arranged at the periphery of the stabilizing member and axially displaced relative the resilient portion, wherein the radial projection is configured to seal against the associated hollow body.

The radial projection may be formed by a resilient material, and it may extend continuously along the periphery of the body of the stabilizing member.

The radial projection may form a radially projecting lip. Optionally, an O-ring may be arranged at the radial projection for further improving the sealing properties of the radial projection. In such embodiment, the actual projection in radial direction may be achieved solely by the radial extension of the O-ring.

The body may have a centrally aligned through hole through which the valve stem of the valve is insertable.

According to a second aspect, an aerosol valve for sealing an open end of a main body of an aerosol container is provided. The aerosol valve comprises a valve stem being movable inside a valve housing between an upper position, in which the valve is closed, and a depressed position in which the valve is open, wherein the valve housing comprises a stabilizing member according to the first aspect.

The valve housing may further comprise a lower valve housing which is connected to the stabilizing member thus forming an upper valve housing.

The lower valve housing may be connected to a dip tube.

According to a third aspect, an aerosol container is provided. The aerosol container comprises a main body having a closed end and an upper end, wherein the upper end is sealed by means of an aerosol valve according to the second aspect.

The upper end may have a narrow portion, an axial end, and a circumferential groove positioned between the narrow portion and the axial end. The resilient portion of the stabilizing member is snap fitted into said groove.

The maximum diameter of the groove may be slightly less than the maximum diameter of the resilient portion.

The radial projection of the stabilizing member may be press fitted against the narrow portion of the main body.

The maximum diameter of the narrow portion may be slightly less than the maximum diameter of the radial projection.

According to a fourth aspect, a method for providing an aerosol container is provided. The method comprises the steps of providing a hollow main body, wherein the main body has a closed bottom end and an open upper end, providing an aerosol valve according to the second aspect, and sealing the open upper end by snap fitting the valve in the main body of the container.

According to an aspect of the invention, a stabilizer for an aerosol valve having a valve housing and a valve stem for operating said valve, said stabilizer comprising a body, and wherein the periphery of said stabilizer is provided with at least one resilient member that extends in a radial direction.

According to a further aspect of the invention, an aerosol valve is provided. The aerosol valve comprises a stabilizer according to the first aspect.

According to a yet further aspect of the invention, an aerosol container is provided. The aerosol container has a closed bottom end and an open upper end, wherein the inside wall of said upper end is provided with a circumferential groove, and wherein said container further comprises an aerosol valve according to the second aspect.

According to another aspect of the invention, a method for providing an aerosol container is provided. The method comprises a first step of extruding a metal blank into a hollow body, wherein the hollow body has a main body, a closed bottom end and an open upper end and wherein the upper end is provided with a circumferential groove. The second step of the method comprises arranging a valve within the walls of the upper end of the container, wherein the valve is an aerosol valve according to the second aspect. The third step of the method comprises sealing the open upper end against the valve body by snapping the at least one resilient members of the stabilizer with the circumferential groove of the hollow body of the container.

According to a yet further aspect of the invention, a method for filling an aerosol container is provided. The method comprises the step of adding the substance, with the exception of the propellant, to the hollow body of the container, and sealing the open upper end against the valve body by snapping the at least one resilient members of the stabilizer with the circumferential groove of the hollow body of the container and injecting the propellant through the aerosol valve.

BRIEF DESCRIPTION OF THE DRAWINGS

Further objects, features and advantages will appear from the following detailed description, with reference being made to the accompanying drawings, in which.

DETAILED DESCRIPTION

The following description focuses on embodiments of the present invention applicable to aerosol containers.

Figure 1:
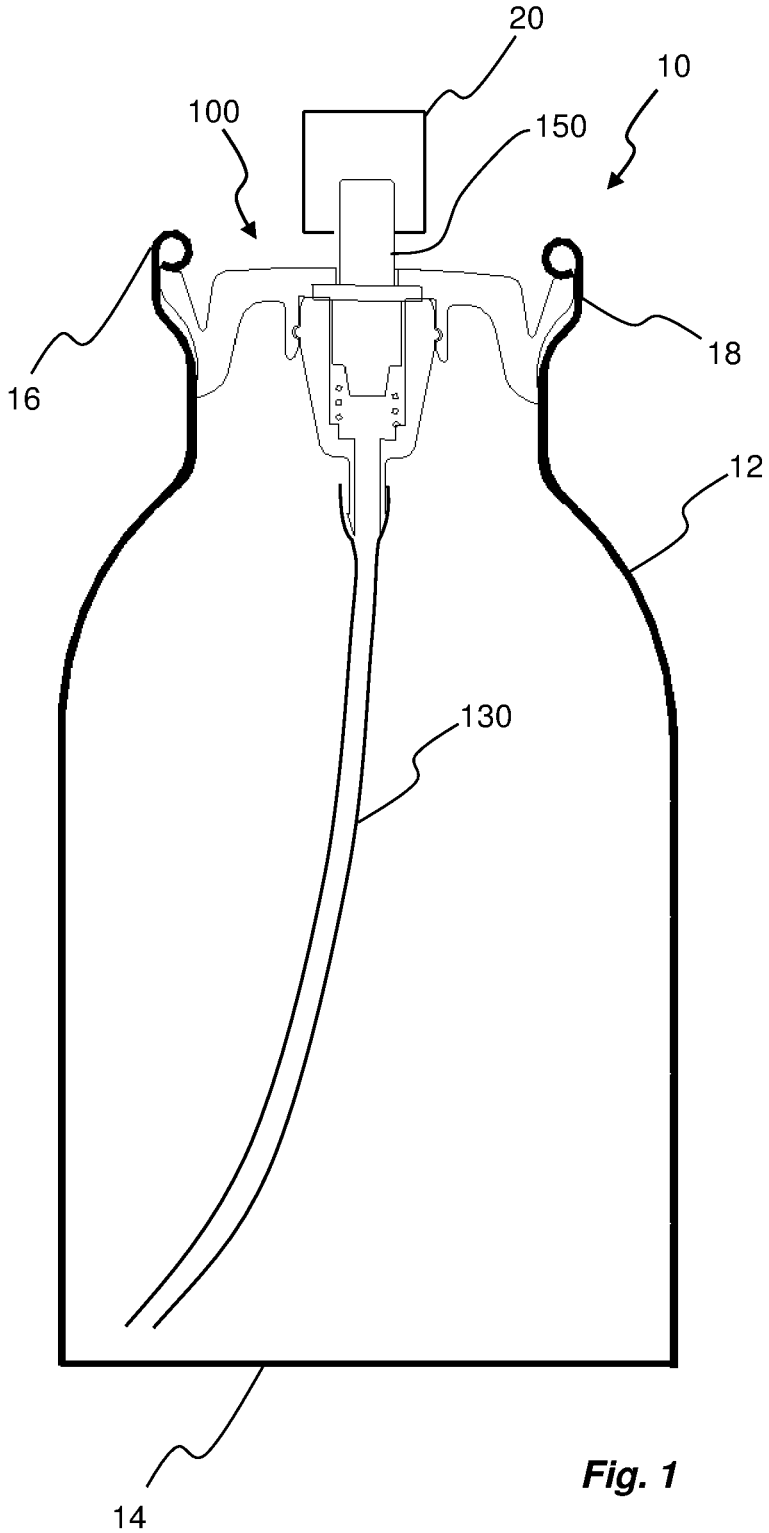
FIG. 1 is a cross-sectional view of an aerosol container according to an embodiment.

In FIG. 1 a schematic view of an aerosol container 10 according to an embodiment is shown. The aerosol container 10 has a main body 12, a closed bottom end 14 and a closed upper end 16. While the bottom end 14 is preferably formed integrally with the main body 12, the upper end 16 is closed by means of an aerosol valve 100. The container may be of cylindrical shape, or other suitable shapes for aerosol applications. For example, one portion of the main body 12 may have a first shape, such as cylindrical, while another portion of the main body 12 may have another shape, e.g. a rectangular cross-section.

Figure 4:
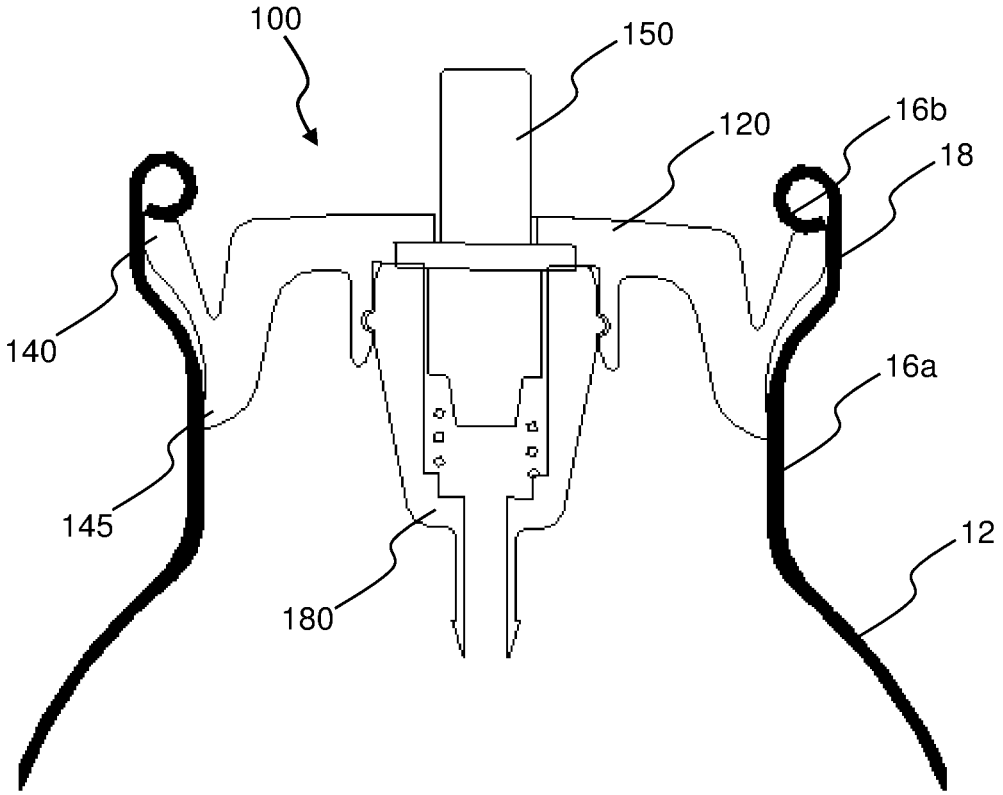
FIG. 4 is a cross-sectional view of parts of an aerosol valve according to an embodiment.

The upper end 16 is provided with a circumferential groove 18, extending in a radial direction outwards as will be described further in accordance with FIG. 4. The valve 100 is arranged inside the container 10, and the valve 100 has an actuator 20 that is provided outside the container 10, connecting to a valve stem 150 extending through the open upper end 16. The valve 100 is opened by applying a downward force on the actuator 20. When the actuator 20 is pressed downwards towards the container 10 the valve 100 is opened and aerosols are allowed to escape from the container 10 through a dip tube 130 arranged inside the container 10. The dip tube 130 has an open end being in contact with the content of the aerosol container 10, and an opposite end being connected to the aerosol valve 100.

The aerosol valve 100 is thus sealing the upper end 16 of the aerosol container 10, such that the content of the aerosol container 10 is prevented from escaping unless a user operates the valve 100.

Figure 2:
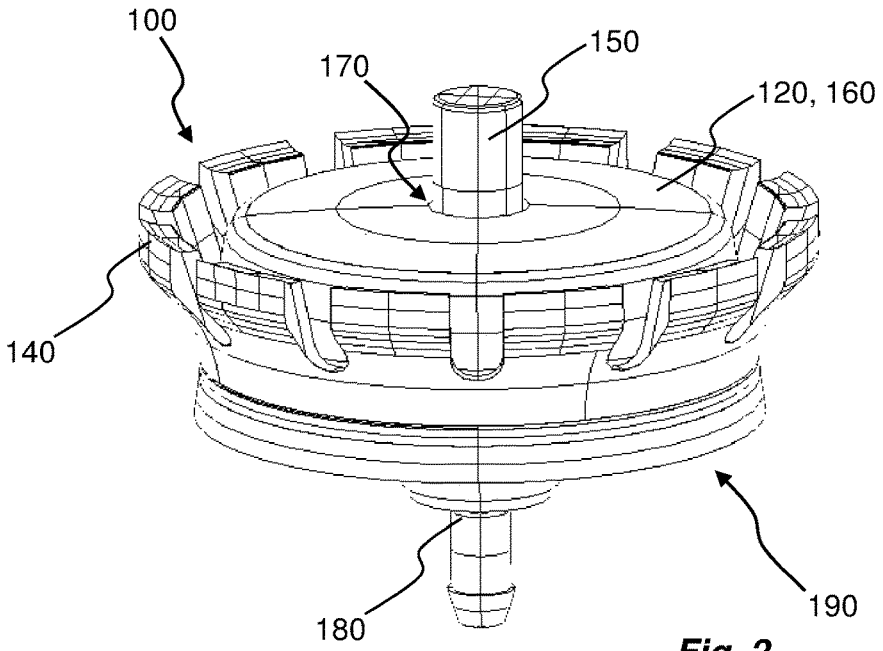
FIG. 2 is an isometric view of an aerosol valve according to an embodiment.
Figure 3:
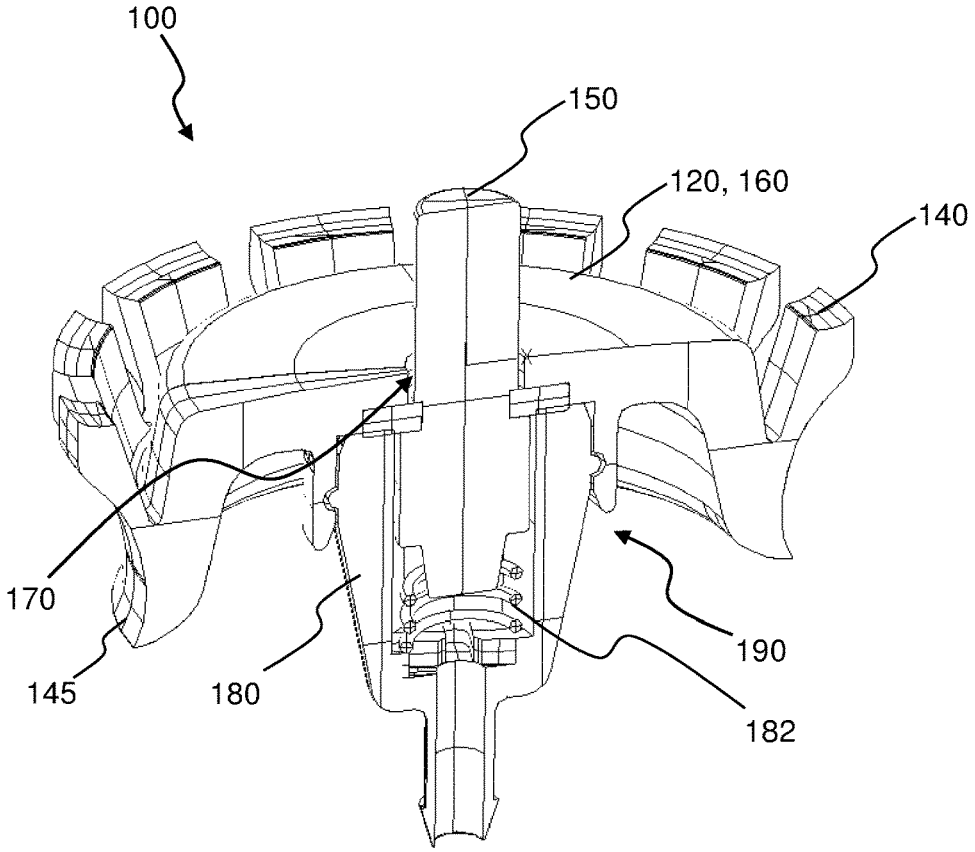
FIG. 3 is an isometric cross-sectional view of an aerosol valve according to an embodiment.

The valve 100 will be described in more details from here on. The valve 100 comprises a stabilizing member 120 as is shown with reference to FIGS. 2 and 3. The stabilizing member 120 is formed as a body 160, preferably being made of a plastic material such as a thermoplastic polymer, and is equipped with a through hole 170 for allowing the valve stem 150 to extend through the stabilizing member 120. The body 160 of the stabilizing member 120 forms an upper valve housing of the valve 100 that acts as a cover for the aerosol valve 100 in the same sense as prior art valve cups.

Hence, the valve stem 150 extends through the upper valve housing 120, i.e. the stabilizing member, via the through hole 170. The valve stem 150, normally being provided with an actuator (see FIG. 1) is extending inwards and into the valve 100.

When the valve stem 150 is subject to a pressing force in a direction downwards, i.e. towards the stabilizing member 120 of the valve housing, an interior channel inside the valve 100 is fluidly connected with the interior of the aerosol container 10 such that the content of the aerosol container 10 is allowed to be discharged through the interior channel of the valve stem 150.

Besides the stabilizing member 120 and the valve stem 150 the aerosol valve 100 normally also comprises a lower valve housing 180. The lower valve housing 180 forms a fluid conduit, and has a lower end to which the dip tube 130 is connected. The lower valve housing 180 is housing a spring 182, as well as a lower portion of the valve stem 150. The spring urges the valve stem 150 upwards, however allows the valve stem 150 to be slidably moveable inside the lower valve housing 180. The valve stem 150 has an interior fluid channel which is formed between one aerosol inlet, arranged at the side surface of the valve stem 150, and an aerosol outlet arranged at the upper portion of the valve stem 150, i.e. at the portion which projects outside the aerosol container 10.

The position of the aerosol inlet is set such that it is sealed, and closed, when the valve stem 150 is in its idle position. When the valve stem 150 is depressed, the aerosol inlet will move downwards whereby it will open and allow the content to enter the fluid channel of the valve stem 150. As soon as the pressing force is removed from the valve stem 150 the spring 182 will urge the valve stem 150 upwards such that the aerosol inlet is closed.

The stabilizing member 120 and the lower valve housing 180 together forms a common valve housing 190; for this, the lower valve housing 180 is connectable to the upper valve housing, i.e. the stabilizing member 120 e.g. by means of a snap fit, a threaded engagement, or similar. A sealing 192 may be provided where the upper valve housing 120 and the lower valve housing 180 lies in contact with each other for preventing leakage. Preferably, the sealing may also form the sealing for closing the aerosol inlet of the valve stem 150.

The outer periphery of the stabilizing member 120 is provided with a resilient portion 140, in the shown example the resilient portion is formed by a plurality of resilient members 140 that extends outwards in a radial direction. The resilient portion 140 thus has a radial extension, as well as an upper surface for engagement with the aerosol container 100 as will be described further below.

In one embodiment the periphery of the stabilizing member 120 is provided with 12 members 140. It should be understood by a person skilled in the art that the number of members 140 could vary depending on design parameters.

Each resilient member 140 forms a spring, such that it will always strive to return to its idle shape and form. If the resilient members 140 are urged radially inwards, i.e. when the stabilizing member 120 is mounted in an aerosol container 10 as will be described below, they will press outwards to seal against the inner surface of the container 100.

The springs 140 may be provided as plastic flanges, extending outwards. The interface where the flanges 140 are connected to the body 160 thus forms a hinge.

In the shown embodiment the stabilizing member is circular. In other embodiments, the stabilizing member 120 may be of triangular shape, in the shape of a square or in any other suitable form.

As described above, the stabilizing member 120 has a resilient portion 140 arranged at its periphery. The stabilizing member 120 has an axial extension, wherein the resilient portion 140 is provided at an upper axial end. The lower axial end of the stabilizing member 120 comprises a radial projection 145. The radial projection 145 may preferably consist of the same material as the rest of the stabilizing member 120. However, the radial projection 145 is continuous along its periphery and forms a radially projecting lip. The outer radius of the radial projection 145 is preferably less than the outer radius of the resilient portion 140. Optionally, an O-ring may be arranged at the radial projection for further improving the sealing properties of the radial projection. In such embodiment, the actual projection in radial direction may be achieved solely by the radial extension of the O-ring.

Figure 5:
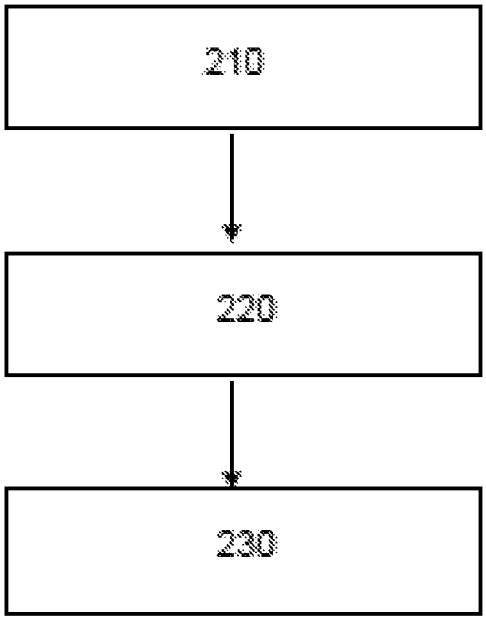
FIG. 5 is a schematic view of a method according to an embodiment.

Parts of the aerosol container 10 are shown in FIG. 5, illustrating the connection between the aerosol container 10 and the aerosol valve 100.

The upper end 16 of the aerosol container's 10 main body 12 has a narrow portion 16*a*, which narrow portion 16*a* may be a cylindrical portion having a slightly less radius than the lower parts of the main body 12. A circumferential groove 18 is provided axially between the narrow portion 16*a* and the axial end 16*b* of the main body 12. The groove 18 is formed radially outwards, such that the groove 18 actually forms a portion having a slightly larger radius than the narrow portion 16*a*, as well as than the axial end 16*b*.

Hence the inside wall of the upper end 16 of the main body 12 is provided with the circumferential groove 18. The radius of the circumferential groove 18 is slightly less than the radius of the resilient portion 140 of the stabilizing member 120. Additionally, the radius of the narrow portion 16*a* is slightly less than the radius of the radial projection 145 of the stabilizing member 120.

Before assembly of the aerosol container 10 the aerosol valve 100 is provided by securely attaching the lower valve housing 180, including the spring 182 and the valve stem 150, to the stabilizing member 120.

When mounting the aerosol valve 100 to the main body 12 in order to form the aerosol container 100 the aerosol valve 100 is positioned adjacent to the upper end 16 of the main body 10. As the radius of the resilient portion 140 is slightly larger than the radius of the groove 18 (as well as than the radius of the axial end 16*b* of the main body 12), the valve 100 can not be put in correct position without a pressing force. The valve 100 is therefore pressed against the main body 12 whereby the resilient portion 140 will deflect slightly inwards allowing the valve 100 to move into the main body 12 to some extent. However, as the radius of the radial projection 145 is slightly larger than the radius of the narrow portion 16*a* also the radial projection needs to deform. When a certain pressure is applied to the valve 100 the resilient portion 140 will snap into the groove 18, preventing the valve 100 from moving upwards. At the same time the radial projection 145 will seal against the narrow portion 18 of the main body 12. A secure and rigid attachment of the valve 100 is thus achieved.

A method 200 for providing an aerosol container will now be described with reference to FIG. 5. In a first step 210, a hollow body is provided e.g. by extruding a metal blank. In a particular embodiment, the hollow body has a main body 12, a closed bottom end 14 and an open upper end 16. The upper end is provided with a circumferential groove 18.

In a subsequent step 220, a valve 100 is arranged within the walls of the upper end 16. The valve has a valve stem 150 that opens the valve 100 when it is depressed. The valve 100 is arranged such that the upper end of the valve stem 150 is facing away from the opening of the upper end 16. The valve further comprises a stabilizing member 120, where the periphery of the stabilizer 120 is provided with a resilient portion extending in a radial direction, as well as a radial projection 145 as described above.

In a next step 230, the open upper end 16 is closed by the valve 100 such that the upper end 16 is closed. The resilient portion 140 of the stabilizer 120 will snap into the circumferential groove 18 of the hollow body 12 of the container, thus creating a secure and robust positioning of the valve 100. The circumferential groove 18 and the resilient portion 140 keeps the stabilizing member 120 in a perfect position relative the main body 12, and the radial projection 145 of the stabilizing member 120 will seal against the inner wall of the container 10. Tests have been performed indicating that a suitable down force required to fit the valve 100 may be in the range of 500-1000 N, depending on the dimensions of the stabilizing member 120 and the main body 12. The distance, from the resting position of the valve 100 prior to the press-fit to the mounted position, may e.g. be in the range of 10-15 mm. Thus, when using the stabilizing member 120 for an aerosol valve 100 the need of a mounting cup, valve cup or sealing gaskets is no longer present.

Figure 6:
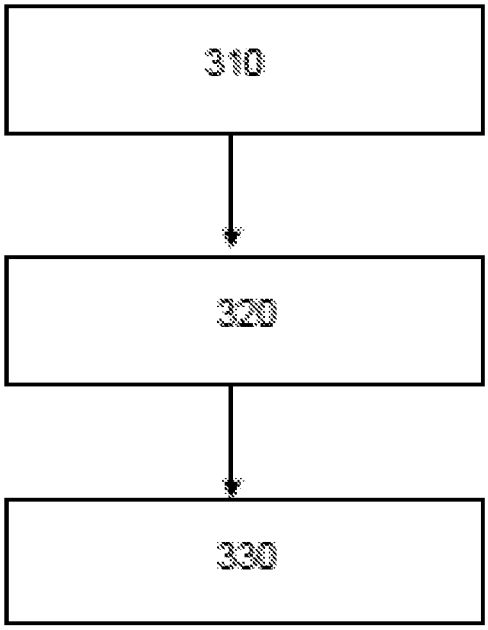
FIG. 6 is a schematic view of a method according to another embodiment.

A method 300 for filling an aerosol container will now be described with reference to FIG. 6.

In a first step 310, all the substance except the propellant is added to the hollow body 12 of the container 10. The substance is usually in the form of a liquid or foam, such as insecticides, deodorants, hair spray and paints.

In a subsequent step 320, the open upper 16 end is closed by the valve 100 such that the upper end 16 is closed as described in the method according to FIG. 5.

In a next step 330, the propellant is injected under pressure through the valve 100. The propellant may be in the form of a liquified gas, or a compressed gas. The propellant may for example be mixtures of volatile hydrocarbons, typically propane and n-butane.

The use of the above-described stabilizing member 120 for aerosol valve applications has been proven to be very efficient for various types of containers as well as for various applications. For example, the main body 12 of the container may be a plastic bottle (preferably for use with non-pressurized content as well as pressurized content), a so called tin-can made of a suitable metal, and steel bottles manufactured e.g. by impact extrusion, etc., as long as the main body 12 has a means for receiving and holding the stabilizing member 120 of a valve. Hence, the only adaptation necessary for existing bottles and containers is to form the upper end such that it exhibits a groove arranged adjacent to a narrow portion.

Hence the aspects of the above description may be implemented for deodorants, perfumes, hair spray, body spray, creams and lotions, sun care products, shaving gel and foam products, hair color, air fresheners, cleaning products, food such as oil, cream, etc, paint, chemicals, glues and adhesives, pesticides, inhalers, etc. Although such products may vary greatly in terms of viscosity, all these products may be handled using different dimensions of the valve and main body.

Although the present invention has been described above with reference to specific embodiments, it is not intended to be limited to the specific form set forth herein. Rather, the invention is limited only by the accompanying claims and, other embodiments than the specific above are equally possible within the scope of these appended claims.

The invention claimed is:

1. A stabilizing member forming an upper valve housing for an aerosol valve having a valve stem for operating said valve, said stabilizing member comprising a body having a resilient portion arranged at a periphery of said stabilizing member for snap fitting in a groove formed on an inside of an associated hollow body, and a radial projection arranged at the periphery of the stabilizing member and axially displaced relative the resilient portion, wherein the radial projection is configured to seal against an inner wall of the associated hollow body, and wherein the radial projection is formed by a resilient material.

2. The stabilizing member according to claim 1, wherein the radial projection extends continuously along the periphery of the body of the stabilizing member.

3. The stabilizing member according to claim 2, wherein the radial projection forms a radially projecting lip.

4. The stabilizing member according to claim 1, wherein the body has a centrally aligned through hole through which the valve stem of the valve is insertable.

5. The aerosol valve for sealing an open end of a main body of an aerosol container, comprising the valve stem being movable inside a valve housing between an upper position, in which the valve is closed, and a depressed position in which the valve is open, wherein the valve housing comprises a stabilizing member according to claim 1.

6. The aerosol valve according to claim 5, wherein the valve housing further comprises a lower valve housing which is connected to the stabilizing member thus forming the upper valve housing.

7. The aerosol valve according to claim 6, wherein the lower valve housing is connected to a dip tube.

8. The aerosol container, comprising a main body having a closed end and an upper end, wherein the upper end is sealed by means of the aerosol valve according to claim 5.

9. The stabilizing member according to claim 1, wherein the resilient portion is arranged at an upper axial end of the stabilizing member, and wherein the radial projection is arranged at a lower axial end of the stabilizing member.

10. The stabilizing member according to claim 1, wherein the resilient portion comprises a plurality of resilient members that extend outwards in a radial direction of the stabilizing member.

11. The aerosol container according to claim 8, wherein the upper end has a narrow portion, an axial end, and a circumferential groove positioned between the narrow portion and the axial end, wherein the resilient portion of the stabilizing member is snap fitted into said groove.

12. The aerosol container according to claim 11, wherein a maximum diameter of the groove is slightly less than a maximum diameter of the resilient portion.

13. The aerosol container according to claim 11, wherein the radial projection of the stabilizing member is press fitted against the narrow portion of the main body.

14. The aerosol container according to claim 13, wherein a maximum diameter of the narrow portion is slightly less than a maximum diameter of the radial projection.

15. An aerosol container, comprising a main body having a closed end and an upper end, wherein the upper end is sealed by means of an aerosol valve comprising a valve stem being movable inside a valve housing between an upper position, in which the valve is closed, and a depressed position in which the valve is open, wherein the valve housing comprises a stabilizing member having a valve stem for operating said valve, said stabilizing member comprising a body having a resilient portion arranged at the periphery of said stabilizing member for snap fitting in a groove of an associated hollow body, and a radial projection arranged at the periphery of the stabilizing member and axially displaced relative the resilient portion, wherein the radial projection is configured to seal against the associated hollow body, wherein the upper end has a narrow portion, an axial end, and a circumferential groove positioned between the narrow portion and the axial end, wherein the resilient portion of the stabilizing member is snap fitted into said groove.

16. The aerosol container according to claim 15, wherein a maximum diameter of the groove is slightly less than a maximum diameter of the resilient portion.

17. The aerosol container according to claim 15, wherein the radial projection of the stabilizing member is press fitted against the narrow portion of the main body.

18. The aerosol container according to claim 17, wherein a maximum diameter of the narrow portion is slightly less than a maximum diameter of the radial projection.

19. A method for providing an aerosol container, comprising the steps of:

providing a hollow main body, wherein the main body has a closed bottom end and an open upper end;

providing an aerosol valve having:

a valve stem being movable inside a valve housing between an upper position, in which the valve is closed, and a depressed position in which the valve is open, wherein the valve housing comprises a stabilizing member, the stabilizing member having a body having a resilient portion arranged at the periphery of said stabilizing member for snap fitting in a groove formed on an inside of the hollow main body, and a radial projection arranged at the periphery of the stabilizing member and axially displaced relative the resilient portion, wherein the radial projection is configured to seal against an inner wall of the hollow main body, and wherein the radial projection is formed by a resilient material, and sealing the open upper end by snap fitting the valve in the main body of the container.

* * * * *